United States Patent [19]

McElroy, Jr.

[11] 4,113,052

[45] Sep. 12, 1978

[54] UNITARY ELASTIC MUFFLER ASSEMBLY FOR A PNEUMATIC DEVICE

[75] Inventor: John O. McElroy, Jr., Pottstown, Pa.

[73] Assignee: Berkmont Industries, Boyertown, Pa.

[21] Appl. No.: 750,330

[22] Filed: Dec. 13, 1976

[51] Int. Cl.[2] ..... F01N 1/08

[52] U.S. Cl. ..... 181/230

[58] Field of Search ..... 181/230, 211, 264, 257

[56] References Cited

U.S. PATENT DOCUMENTS

| | | | |
|---|---|---|---|
| 2,152,205 | 3/1939 | Morrison | 181/230 |
| 3,459,275 | 8/1969 | Prillwitz et al. | 181/230 |
| 3,554,316 | 1/1971 | Judd | 181/230 |

FOREIGN PATENT DOCUMENTS

| | | | |
|---|---|---|---|
| 47,382 | 4/1966 | German Democratic Rep. | |
| 329,237 | 5/1930 | United Kingdom | 181/230 |
| 810,398 | 3/1959 | United Kingdom. | |

*Primary Examiner*—Robert C. Watson
*Attorney, Agent, or Firm*—Joseph Scafetta, Jr.

[57] ABSTRACT

A unitary, elastic muffler assembly includes an arcuate, channel-shaped, sound-muffling section having opposite ends bridged by an integral elastic band. The assembly is telescoped over the tubular housing of a pneumatic device into a position to receive spent working fluid exiting from housing vents into the central area of the sound-muffling section wherein the fluid divides and follows arcuate flow paths defined by the tubular housing and the sound-muffling section through sound-attenuating material to exhaust ports located in the end walls of the sound-muffling section. The movement of the fluid along the defined flow paths of a total arcuate extent substantially greater than 90° diminishes the noise level of the spent working fluid below 90 dBAs. Also, the fluid movement away from the housing vents avoids causing icing up or significant reducing of the operating efficiency of the pneumatic device.

9 Claims, 8 Drawing Figures

UNITARY ELASTIC MUFFLER ASSEMBLY FOR A PNEUMATIC DEVICE

BACKGROUND OF THE INVENTION

1. Field of the Invention

This invention relates to acoustics, in particular, to fluid-conducting mufflers combined with pneumatic devices.

2. Description of the Prior Art

Spent working fluid from impulsive motion and impacts of air-operated hand tools and other pneumatic devices is a major source of in-plant noise pollution. Due to the present national concern about noise pollution, the U.S. Congress enacted the Occupational Safety and Health Act (hereinafter OSHA), effective April, 1971. Thereunder, the U.S. Department of Labor promulgated regulation 1910.95 in 39 Federal Register 23596 (June 27, 1974). The regulation governs the permissible noise exposure for employees inside a plant and requires that engineering controls be utilized to reduce sound levels below stated limits. For example, the noise exposure for employees over an eight hour period should not exceed 90 decibels on the A scale of a standard sound level meter at slow response (hereinafter dBAs). Many unmuffled air-operated hand tools and other pneumatic devices are not in compliance with this OSHA regulation. Many attempts to muffle such tools and pneumatic devices have been unsatisfactory because of icing up of the vents or a significant reducing in operating efficiency of the tools and pneumatic devices.

Exemplary prior art rubber mufflers designed for specific pneumatic devices are shown and described in U.S. Pat. Nos. 2,152,205, 3,225,861, 3,459,275 and 3,554,316. Exemplary non-elastic mufflers are shown and described in East German Pat. No. 47,382, British Pat. No. 810,398, and U.S. Pat. Nos. 3,891,049 and 3,993,159.

However, it is still a problem in the acoustic art to manufacture a cheap, easily manufactured, effective, unitary, elastic muffler assembly for reducing the noise level of air-operated hand tools and other pneumatic devices below the 90 dBA level without icing up or reducing significantly the efficiency of such tools and devices and for telescopingly engaging tubular housings of variously sized air-operated hand tools and other pneumatic devices.

SUMMARY OF THE INVENTION

It is a primary object of the invention to provide a cheap, easily manufactured, effective, unitary, elastic muffler assembly for reducing the noise caused by spent working fluid from vents in a tubular housing of a pneumatic device to a level below 90 dBAs without icing up or reducing the efficiency of such a device by providing the muffler with an arcuate, channel-shaped, sound-muffling section of an extent substantially greater than 90° that defines, with the tubular housing of the pneumatic device, an arcuate, sound-muffling, fluid flow path from the housing vents into a central fluid receiving area through sound-attenuating material of density approximately 0.005 pounds per cubic inch to exhaust ports having an open area ratio of 1.0:1.5 with said housing vents, said ports being located in the end walls of the sound-muffling section.

It is an additional object of the invention to provide a unitary, elastic muffler assembly adapted for telescopic engagement with the tubular housings of variously sized pneumatic devices exhausting spent working fluid from a discrete peripheral segment of the tubular housing.

DESCRIPTION OF THE PREFERRED EMBODIMENTS

Figure 1:
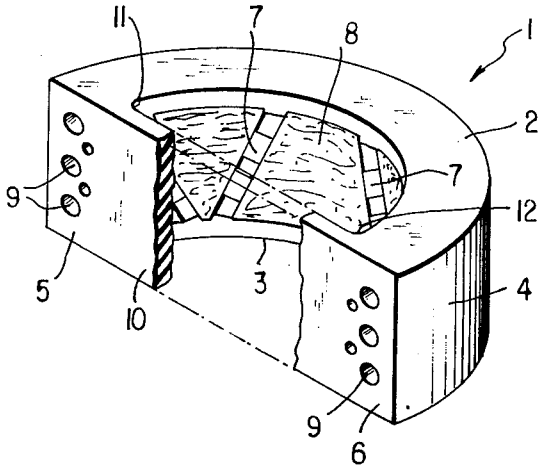
FIG. 1 is an isometric view from the underside of a first embodiment of a unitary, elastic muffler assembly in its unexpanded condition.
Figure 2:
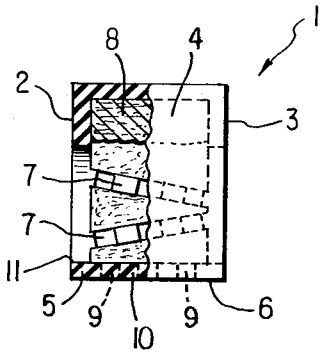
FIG. 2 is a side elevational view, partially in section, of the embodiment illustrated in FIG. 1.
Figure 3:
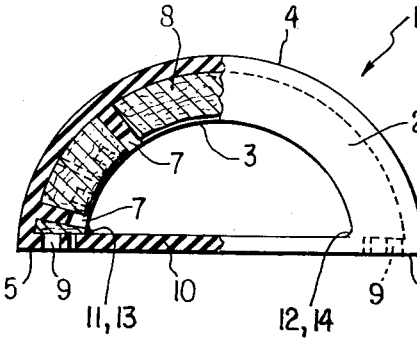
FIG. 3 is a front elevational view, partially in section, of the embodiment illustrated in FIG. 1.

In FIGS. 1 through 3, a first preferred embodiment of a unitary, elastic muffler assembly has an arcuate, channel-shaped, sound-muffling section 1 extending 180°. Although the arcuate section 1 extends 180°, the number of degrees is illustrative only. Empirical tests show that arcuate extents of less than 90° defined an exhaust fluid flow path too short to reduce the noise level below 90 dBAs. Therefore, arcuate section 1 may extend any number of degrees substantially greater than 90° up to approximately 315°. Empirical tests also show that, when the arcuate extent of section 1 appreciably exceeded 315°, the exhaust fluid flows exiting opposite ends of section 1 begin to interfere with each other and consequently increase the dBA level of the exhaust noise.

The arcuate, channel-shaped, sound-muffling section 1 has spaced, parallel side walls 2 and 3 of equal height when measured radially and a channel top wall 4 connecting the radially outer edges of said side walls 2 and 3. The arcuate, channel-shaped section 1 terminates at opposite end walls 5 and 6. A plurality of baffle structures 7 extend diagonally across channel-shaped section 1 between side walls 2 and 3. Although the baffles 7 are shown to be diagonal, they may extend at right angles between the side walls 2 and 3 or, optionally, they may not be made a part of the assembly.

Sound-attenuating material 8 substantially fills the inside of the arcuate, channel-shaped section 1 and is contained by the channel top wall 4 between the side walls 2 and 3, the baffle structures 7, and the end walls 5 and 6. The preferred sound-attenuating material 8 is felt having a packing density of approximately 0.005 pounds per cubic inch. This felt is manufactured by Thermwell Products Co., Inc., Patterson, N.J., 07524 and is usually used as weatherstripping around doors and windows. Less dense types of sound-attenuating material, such as steel wool and foam sponge rubber, were not found to reduce the noise level of spent working fluid as low as the preferred felt in the sound-muffling section 1. More dense types of sound-attenuating material, such as fiber glass, spun glass, and cotton waste, were found to cause a back pressure inside the pneumatic device resulting in icing up of the housing vents 16 and in an unacceptable reduced efficiency of the air motor.

The end walls 5 and 6 have fluid exhaust ports 9 therethrough. Although the ports 9 are shown to be a plurality of variously sized holes, there may be only one large hole or a plurality of similarly sized holes. Empirical tests show that, in order to allow outward escape of the expanding spent working fluid without causing a significant back pressure inside the pneumatic device, the ratio of the open area of the tool vents 16 to the open area of the ports 9 must be at least 1.0:1.5.

An elastic band 10 bridges the end walls 5 and 6 of the sound-muffling section 1. Rounded fillets 11, 12, 13, and 14 at the corner junctures of the band 10 and the sound-muffling section 1 are provided in order to reduce the stress at the corners whenever the band 10 is expanded to telescopingly engage the tubular housing of a pneumatic device.

The sound-muffling section 1 and the band 10 are molded integrally into a unitary assembly of elastic material. Such a one-piece assembly is easily and cheaply manufactured by mass production processes and does not have any separate fastening means, such as metal screws, nuts and bolts, buckles, etc., as in many prior art mufflers.

The preferred composition of the assembly is a rubber compound known as GRS-60 which is manufactured by Artcraft Rubber Products, Inc., P.O. Box 363, Douglassville, Pa., 19518. The preferred composition has a 1,400 pound tensile strength and a 400% elongation. This rubber is usually used in the manufacture of some types of automobile tires. Other compositions with similar mechanical properties may also be used for purposes of this invention.

Figure 4:
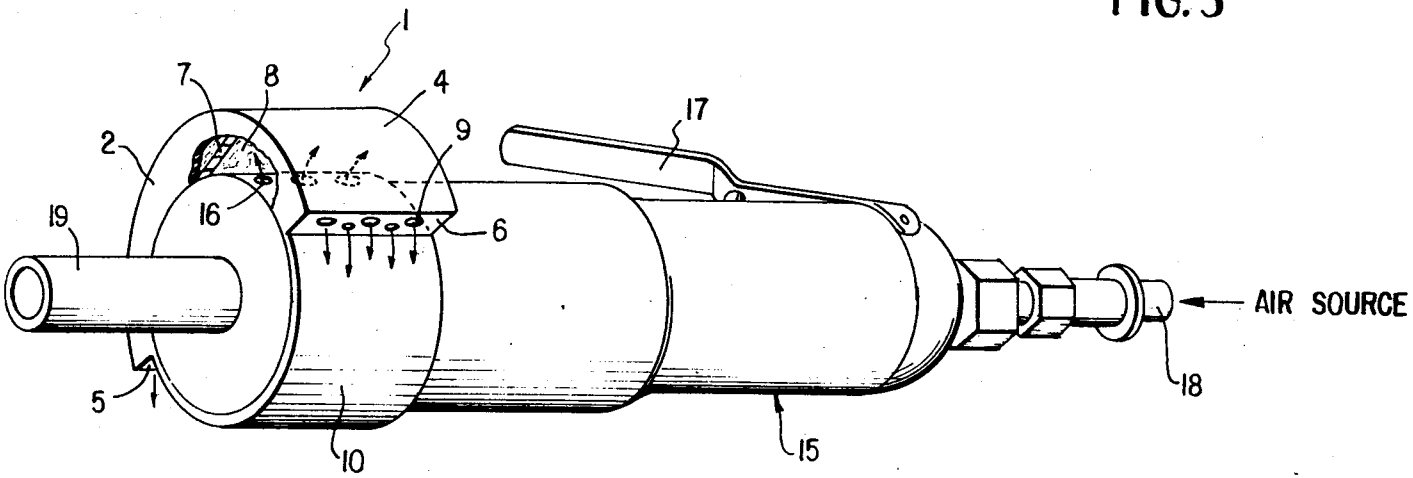
FIG. 4 is a cut-away isometric view of the embodiment illustrated in FIG. 1 in one expanded condition on a first air-operated tool.

In FIG. 4, the first embodiment of the muffler assembly is shown in one expanded condition on a first pneumatic device, i.e., a Cleco air-operated hand tool model 11 GLS 250. The illustrated tool has a generally tubular housing 15 with a plurality of side vents 16 exhausting spent working fluid from a discrete peripheral segment of the housing 15. The muffler assembly may be expanded more or less to telescopingly engage tubular housings of other air-operated tools having greater or lesser diameters within the elastic limits of the preferred rubber composition. The tubular housing of a pneumatic device need not be cylindrical, as in the case of the illustrated model, but may be octagonal, hexagonal, elliptical, etc. The side walls 2 and 3 of the sound-muffling section 1 would be adaptable to conform substantially to the peripheral segment of the tubular housing of such a noncylindrical device.

The operation of the first embodiment of the muffler assembly illustrated in FIGS. 1 through 4 is as follows. The unexpanded muffler assembly, as shown in FIG. 1, is either by hand or by means of a special tool telescopingly expanded and slipped over the tubular housing 15 of the air-operated tool, as shown in FIG. 4. After the muffler assembly is released to allow it to engage the tool, the arcuate, channel-shaped, sound-muffling section 1 is adjusted around the tubular housing 15 so that a central fluid receiving area comprising a minor arcuate segment of the sound-muffling section 1 overlies the tool vents 16 which exhaust spent working fluid from a discrete peripheral segment of the tubular housing 15. The radially inner edges of the side walls 2 and 3 of the sound-muffling section 1 adapt themselves to conform substantially to a peripheral segment of the tubular housing 15.

The elastic band 10 engages the remaining peripheral segment of the tubular housing 15 in order to retain the sound-muffling section 1 in overlying relationship with the side vents 16.

The first air-operated tool is actuated by depressing the handle 17 which allows air to enter the interior of the tubular housing 15 through an inlet 18 from an air source. The air enters an air motor, e.g., a turbine, inside the tubular housing 15 and drives a tool (not shown) by means of a drive shaft 19. The working fluid leaving the air motor is exhausted through side vents 16 in a discrete peripheral segment of the tubular housing 15. In the Cleco hand tool model illustrated in FIG. 4, the side vents 16 exhaust the working fluid perpendicularly into a central receiving area comprising a minor arcuate segment of the sound-muffling section 1. However, other air-operated tools and pneumatic devices may have side vent means which exhaust the spent working fluid at an angle other than 90° through a discrete peripheral segment of their tubular housings.

The spent working fluid from the side vents 16 immediately enters the central fluid receiving area comprising a minor arcuate segment of the sound-muffling section 1, divides, and follows two oppositely directed arcuate, sound-muffling, fluid flow paths defined by said arcuate section 1 with the tubular housing 15. The noise level of the spent working fluid is constantly diminished as it moves outwardly along the two defined arcuate fluid paths through the sound-attenuating material 8, across the baffle structures 7, to the exhaust ports 9 in the opposite end walls 5 and 6. Finally, the spent working fluid passes through the exhaust ports 9 to the atmosphere at a reduced noise level.

The sound-attenuating material 8 has a density of approximately .005 pounds per cubic inch. The side vents 16 and the exhaust ports 9 have an open area ratio of at least 1.0:1.5. It has been discovered that, with these parameters, the spent working fluid does not cause any icing up of the vent 16 and causes only a slight back pressure in the air motor. This back pressure reduces the operating efficiency of the tool by an acceptable five to seven percent. The efficiency loss was calculated by measuring the rpms of the air motor while free running with the tool unmuffled and comparing the measurement with that of the rpms of the air motor while free running with the tool muffled.

The arcuate, channel-shaped, muffler section 1 directs the spent working fluid substantially tangentially to the circumference of the tubular housing 15 through the exhaust ports 9. The tangential direction is preferred because of the ease of making the exhaust ports 9 at right angles through the end walls 5 and 6. Also, exhaustion of the spent working fluid tangentially to the circumference of the tubular housing 15 does not cause the exhausted fluid to agitate any grits, grinds, dirt, sawdust, etc., that may be produced by the tool (not shown) on the end of drive shaft 19, thus preventing such debris from blowing into the eyes of the laborer using the air-operated tool.

Figure 7:
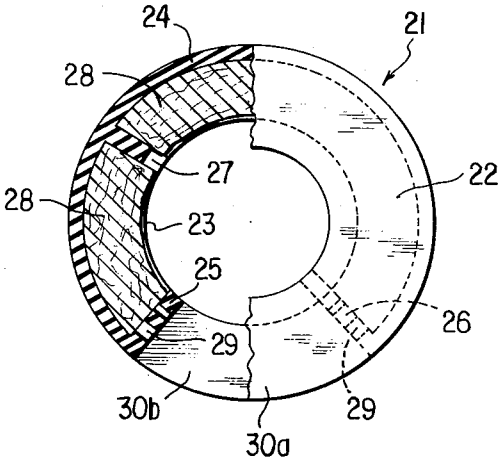
FIG. 7 is a front elevational view, partially in section, of the embodiment illustrated in FIG. 5.
Figure 6:
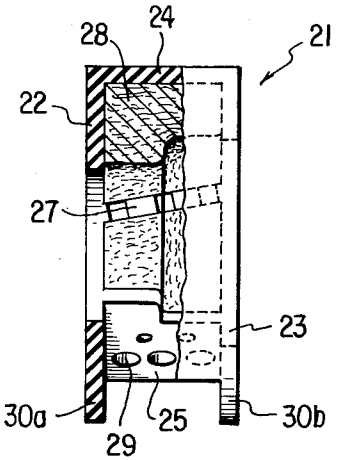
FIG. 6 is a side elevational view, partially in section, of the embodiment illustrated in FIG. 5.
Figure 5:
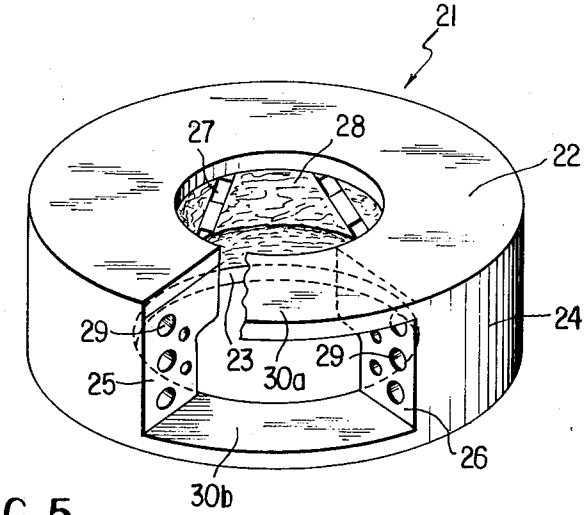
FIG. 5 is an isometric view from the underside of a second embodiment of a unitary, elastic muffler assembly in its unexpanded condition.

Turning to FIGS. 5 through 7, a second preferred embodiment of a muffler assembly has a channel-shaped, sound-muffling section 21 with an arcuate extent of approximately 300°. The housing 21 has a side wall 22 of a first height measured radially. Spaced therefrom and parallel to said side wall 22, there is a side wall 23 of a second height measured radially. A channel top wall 24 connects the radially outer edges of said side walls 22 and 23. The arcuate, channel-shaped section 1 terminates at opposite, stepped, end walls 25 and 26. A plurality of stepped baffle structures 27 extend diagonally between the side walls 22 and 23. Sound-attenuating material 28 substantially fills the inside of the arcuate, channel-shaped section 21 and is contained by the channel top wall 24 between the side walls 22 and 23, the stepped baffle structures 27, and the stepped end walls 25 and 26. The stepped end walls 25 and 26 have fluid exhaust ports 29 therethrough. Elastic band 30*a* of a first radial height and elastic band 30*b* of a second radial height bridge the end walls 25 and 26, thus forming an integrally molded unitary assembly of elastic material with the sound-muffling section 21.

Figure 8:
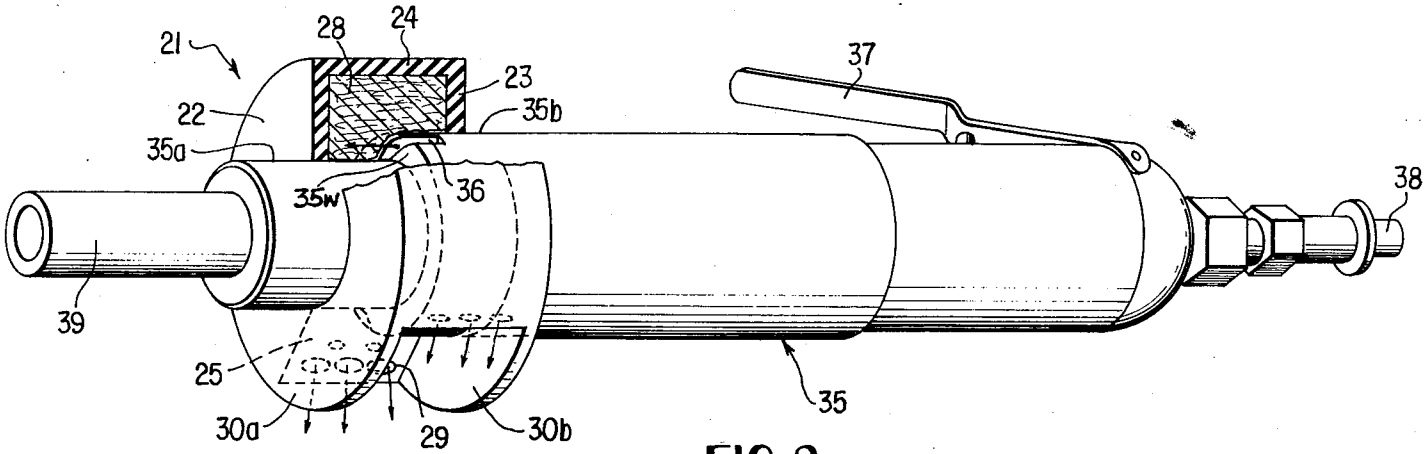
FIG. 8 is a cut-away isometric view from the underside of the embodiment illustrated in FIG. 5 in one expanded condition on a second air-operated tool.

In FIG. 8, the second embodiment of the muffler assembly is shown in one expanded condition on a second pneumatic device, i.e., a Black & Decker air-operated hand tool model 4420, type 2. The illustrated tool has a generally tubular housing 35 with a first front section 35*a* of a first diameter and a second rear section 35*b* of a second greater diameter. The tubular housing 35 also has a lateral wall 35*w* between the first section 35*a* and the second section 35*b*. Although the lateral wall 35*w* forms a step at a substantially right angle between the first section 35*a* and the second section 35*b* of the tubular housing 35, the lateral wall 35*w* may slope at any other angle between the sections 35*a* and 35*b*. There is a vent 36 in the lateral wall 35*w* for exhausting spent working fluid frontwardly by means of a forwardly directed jet (not shown) along an axis parallel to the longitudinal axis of the illustrated air-operated tool.

The operation of the second embodiment of the muffler assembly illustrated in FIGS. 5 through 8 is as follows. The unexpanded muffler assembly, as shown in FIG. 5, is either by hand or by means of a special tool telescopingly expanded and slipped over the tubular housing 35 of the air-operated tool, as shown in FIG. 8. After the muffler assembly is released to engage the tubular housing 35, the arcuate, channel-shaped, sound-muffling section 21 is adjusted around the tubular housing 35 so that a central fluid receiving area comprising a minor arcuate segment of the sound-muffling section 1 overlies the forwardly directed air jet in the vent 36. The radially inner edges of the side walls 22 and 23, along with the radially inner edges of the stepped baffle structures 27 and the stepped end walls 25 and 26, adapt themselves to conform substantially to a peripheral segment comprising portions of the first section 35*a*, second section 35*b*, and the lateral wall 35*w* of the tubular housing 35. The radially inner edges of the bands 30*a* and 30*b* engage the remaining peripheral segment comprising portions of the first section 35*a* and the second section 35*b*, respectively, of the tubular housing 35 in order to retain the sound-muffling section 21 in overlying relationship with the air jet in the vent 36 in lateral wall 35*w*.

The second air-operated tool is actuated by depressing the handle 37 which allows air to enter the interior of the tubular housing 35 through an inlet 38 from an air source. The air enters an air motor inside the tubular housing 35 and drives a tool (not shown) by means of a drive shaft 39. The spent working fluid leaving the air motor is exhausted through the air jet in vent 36 in a discrete peripheral segment of the lateral wall 35*w* of the tubular housing 35. In the Black & Decker hand tool model illustrated in FIG. 8, the air jet in vent 36 exhausts the spent working fluid frontwardly along an axis parallel to the longitudinal axis of the tubular housing 35 into a central receiving area comprising a minor arcuate segment of the sound-muffling section 21. However, other air-operated tools and pneumatic devices may have frontwardly directed vent means which exhaust the spent working fluid at an angle other than 90° from a discrete peripheral segment in a lateral wall of their tubular housings.

The spent working fluid from the frontwardly directed jet in the vent 36 immediately enters the central fluid receiving area comprising a minor arcuate segment of the sound-muffling section 21, divides, and follows two, oppositely directed, arcuate, sound-muffling, fluid flow paths defined by said arcuate channel-shaped, sound-muffling section 21 with portions of first section 35*a*, second section 35*b*, and lateral wall 35*w* of the tubular housing 35. The noise level of the spent working fluid is constantly diminished as it flows outwardly along the two defined arcuate fluid paths through the sound attenuating material 28, across the stepped baffle structures 27, to the exhaust ports 29 in the stepped end walls 5 and 6. Finally, the spent working fluid passes through the exhaust ports 29 to the atmosphere at a reduced noise level.

In the second embodiment of the muffler assembly, as in the first embodiment, the spent working fluid traveling the arcuate paths described above does not cause any icing up of the air jet in the vent 36 and causes only an insignificant back pressure.

Noise level tests were conducted with the first and second embodiments of the muffler assembly on variously sized air-operated hand tools. The dBA readings were measured on the A scale of a sound level meter model SPL-103 manufactured by Columbia Research Laboratories, Inc., at a distance of 24 inches from the tools. For each of the devices tested, the reduced noise level as a result of using the muffler assembly was well within the 90 dBA level. The test results were as follows:

| Hand Tool Model | Manufacturer | dBA Level, Unmuffled | dBA Level, Muffled | Embodiment |
|---|---|---|---|---|
| 11 GLS 250 | Cleco | 99 | 83 | 1 |
| 4420, type 2 | Black & Decker | 99 | 83 | 2 |
| 7089B | Aro | 107 | 87 | 1 |
| 7149 | Aro | 96 | 86 | 1 |
| Multi-vane, Size 0 | Ingersoll-Rand | 100 | 82 | 2 |

The foregoing preferred embodiments are considered as illustrative only. Numerous modifications and changes will readily occur to those skilled in the art.

I claim:

1. A unitary, elastic muffler assembly adapted for telescopic engagement with the tubular housings of variously sized pneumatic devices exhausting spent working fluid from vents in a discrete peripheral segment thereof, comprising:

a. an arcuate, channel-shaped, sound-muffling section terminating at opposite end walls bridged by elastic band means, said sound-muffling section having a central fluid receiving area comprising a minor arcuate segment of the sound-muffling section and having fluid exhaust ports in said opposite end walls, said central fluid receiving area dividing said spent working fluid into two oppositely directed arcuate fluid flow paths;

b. sound-attenuating material substantially filling said arcuate, channel-shaped, sound-muffling section; and c. baffle structures extending between side walls of said sound-muffling section;

whereby, upon telescoping said assembly over the tubular housing of a pneumatic device, said arcuate, channel-shaped, sound-muffling section defines, with the tubular housing, two arcuate, sound-muffling, oppositely directed fluid flow paths divided from said central fluid receiving area through said sound-attenuating material and through said baffle structures to said exhaust ports in said opposite end walls.

2. A unitary, elastic muffler assembly, according to claim 1, wherein said sound-muffling section extends substantially more than 90° around the circumference of the tubular housing of a pneumatic device.

3. A unitary, elastic muffler assembly, according to claim 1, wherein said sound-muffling section directs the spent working fluid substantially tangentially to the circumference of said tubular housing through said exhaust ports in said end walls.

4. A unitary, elastic muffler assembly, according to claim 1, wherein the ratio of the open area of the vents in said discrete peripheral segment in said tubular housing of a pneumatic device to the open area of said fluid exhaust ports in said end walls of said sound-muffling section is at least approximately 1.0:1.5.

5. A unitary, elastic muffler assembly, according to claim 1, wherein the packing density of said sound-attenuating material substantially filling said sound-muffling section is approximately 0.005 pounds per cubic inch.

6. A unitary, elastic muffler assembly, according to claim 1, wherein said baffle structures extend diagonally between the side walls of said sound-muffling section.

7. A unitary, elastic muffler assembly, according to claim 1, wherein said opposite end walls of said arcuate, channel-shaped, sound-muffling section are bridged by integral elastic band means.

8. A unitary, elastic muffler assembly, according to claim 1, wherein said sound-muffling section extends approximately 180° around the circumference of the tubular housing of a pneumatic device.

9. A unitary elastic muffler assembly, according to claim 1, wherein said sound-muffling section extends less than 315° around the circumference of the tubular housing of a pneumatic device.

* * * * *